United States Patent [19]

Phillips et al.

[11] 4,395,154

[45] Jul. 26, 1983

[54] GEODESIC DOME CONNECTOR

[76] Inventors: Martha E. Phillips, 3906 Ridgecroft Rd., Baltimore, Md. 21206; Roger A. Dudik, 21619 Gunpowder Rd., Lineboro, Md. 21088

[21] Appl. No.: 307,530

[22] Filed: Oct. 1, 1981

[51] Int. Cl.[3] ..... F16B 7/00

[52] U.S. Cl. ..... 403/172; 52/80

[58] Field of Search ..... 403/169, 170, 171, 172, 403/173, 174, 175, 176, 177, 178; 52/80, 81

[56] References Cited

U.S. PATENT DOCUMENTS 3,688,461 9/1972 Rensch ..... 403/174 X 4,260,276 4/1981 Phillips ..... 403/172

FOREIGN PATENT DOCUMENTS 566865 2/1960 Belgium ..... 403/172

*Primary Examiner*—Andrew V. Kundrat

*Attorney, Agent, or Firm*—John F. McClellan, Sr.

[57] ABSTRACT

A geodesic dome connector system of the type having a tubular polygonal hub supporting a radial array of arms provides for precision assembly of a variety of types of connectors by pre-assembly of respective arms to two peripherally extending faceted sections which form on resilient assembly about a template the tubular polygonal hub, the template being affixed as a gusset bracing the connector; structure defining apertures between tubular polygonal hub and template or gusset which permit looser tolerances on bending of the tubular polygonal hub parts and provide easier assembly with less distortion.

2 Claims, 7 Drawing Figures

FIG. 1
OLD ART
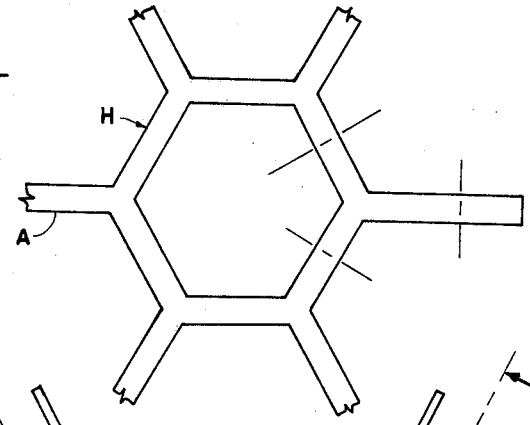
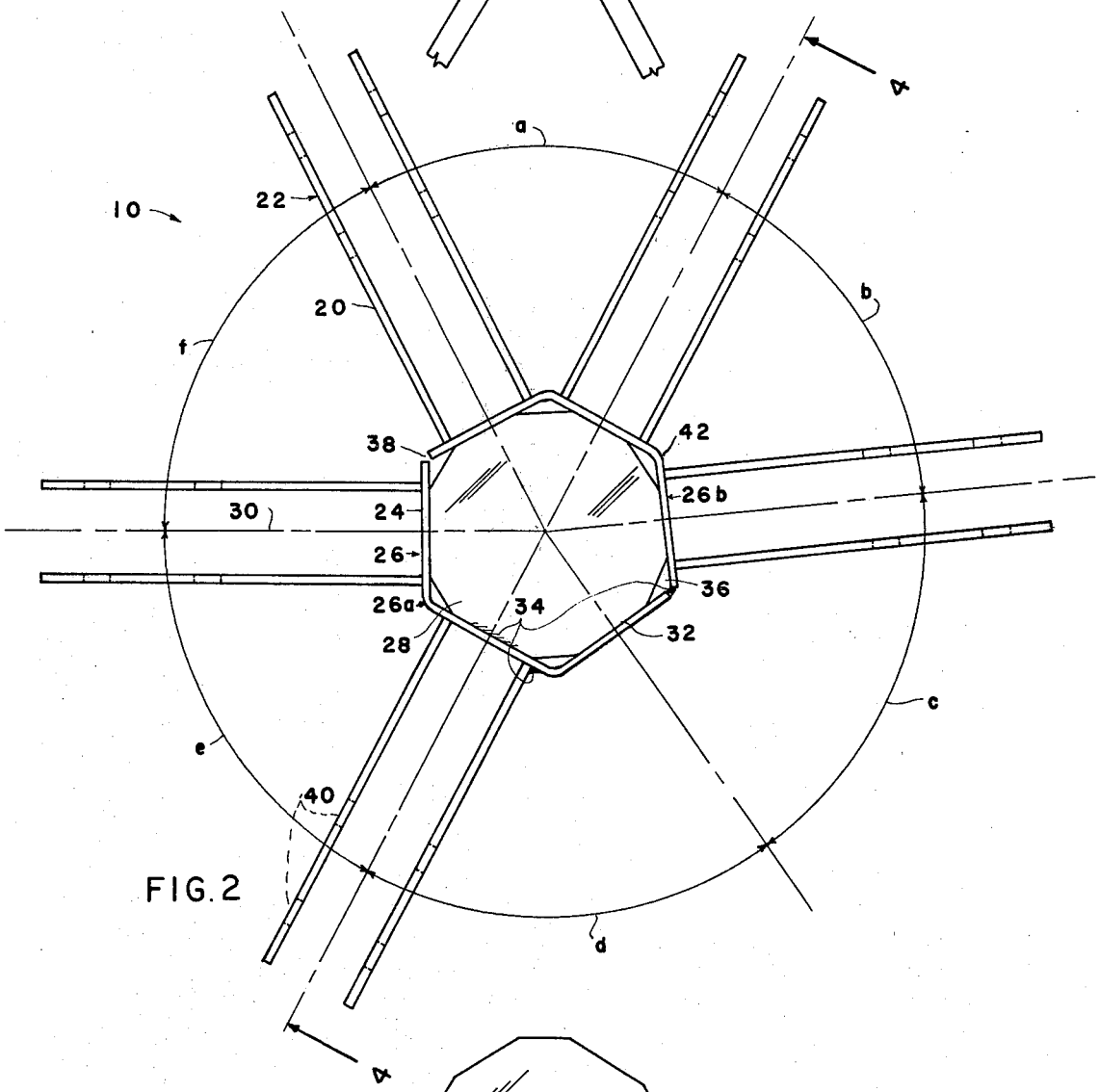
FIG. 2
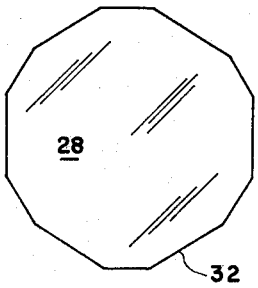
FIG. 3

FIG. 4
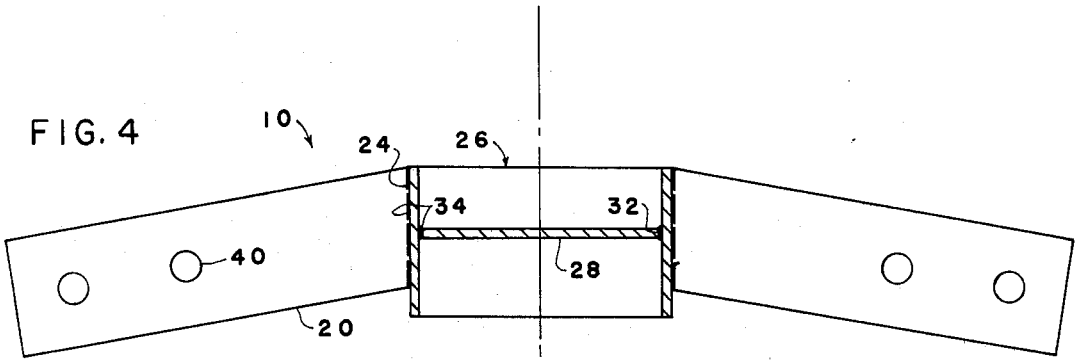
FIG. 5
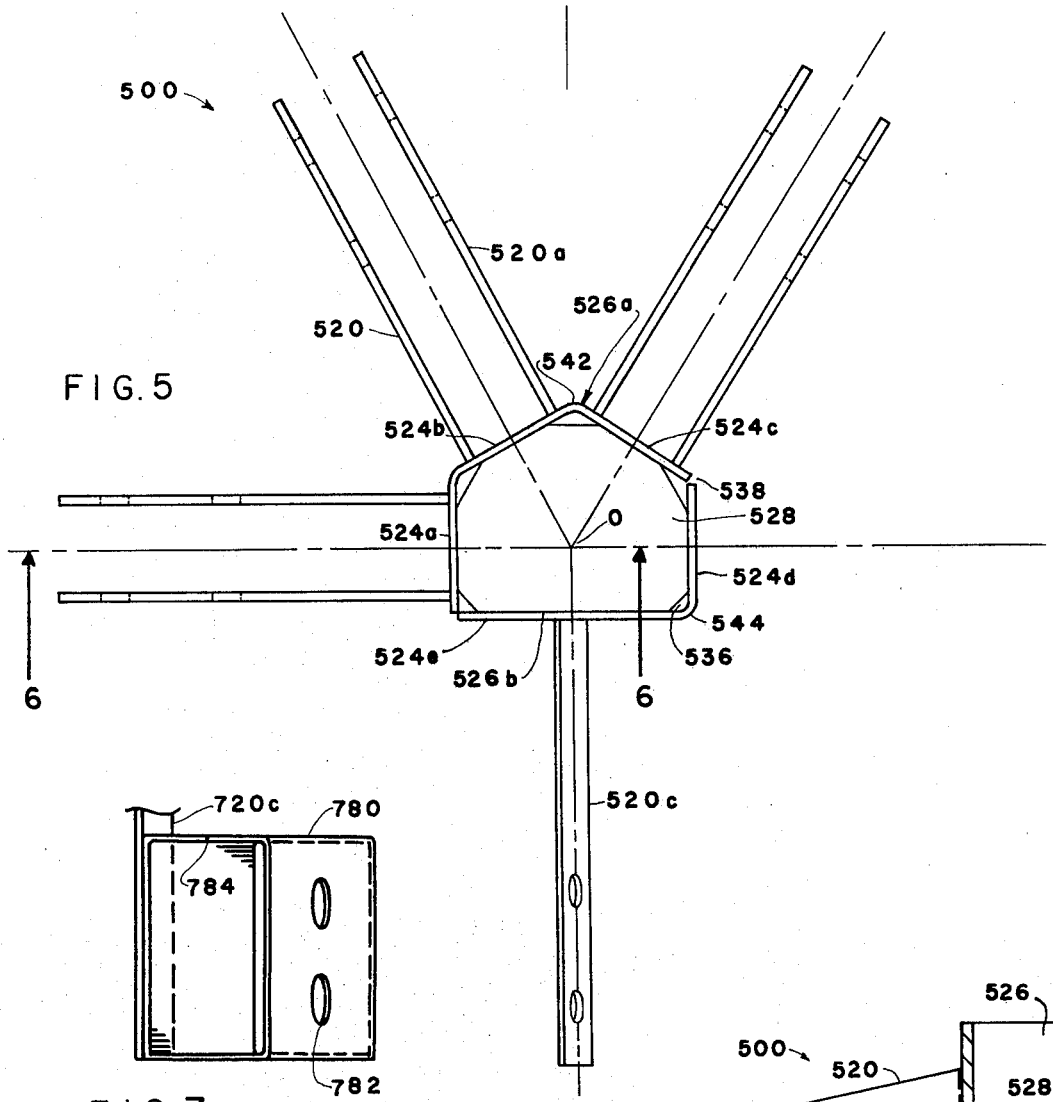
FIG. 7
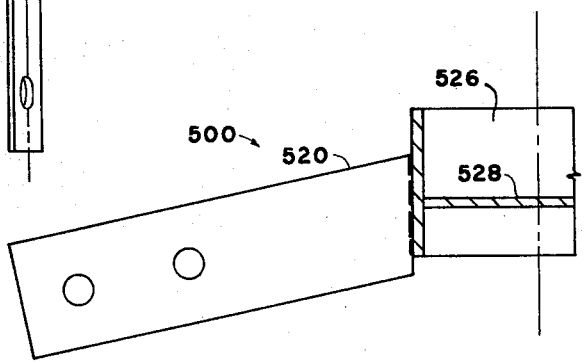
FIG. 6

GEODESIC DOME CONNECTOR

FIELD OF THE INVENTION

This invention relates generally to geodesic dome construction and specifically to connectors for use with same.

PRIOR ART

Various geodesic dome constructions have been known in the prior art including the paired-arm/polygonal hub connector in applicant's U.S. Pat. NO. 4,260,276 issued Apr. 7, 1981 for Geodesic Dome Connector. Also exemplary of polygonal hub connectors are U.S. Pat. No. 3,688,461 issued Sept. 5, 1972 to E. G. Rensch, and Belgian Pat. No. 566,865 issued May 14, 1968 to Societe T. Wuppermann, which shows integral gusset forming a cup-like structure.

BACKGROUND OF THE INVENTION

However, a problem with most, if not all, such connector systems is that a single geodesic dome design can demand not one but a plurality of different connector shapes for construction. The different shapes may include different aximuthal angles or peripheral-angles between arms, different elevational angles between arms and hub, different positioning of arms along the length of the hub, different arm lengths and attachment distances, different arm orientations about arm long axes, and the like. In particular the requirement for differing arm-azimuthal angles is difficult to meet economically and precisely, particularly if the arms are to be in plan view, perpendicular to facets of a tubular polgonal hub. Such hubs are expensive and demanding to make piece by piece and casting systems are too inflexible to permit practical variations of the type required.

OBJECTS OF THE INVENTION

Objects of the invention therefore are to provide a connector system for geodesic dome construction which permits production of a variety of different connectors of the type having a tubular polygonal hub, with speed, economy and accuracy.

Further objects are to provide a system as described which employs a bracing part of the system as a precision guide and template during assembly of flexible-hub-portions to it.

Still further objects are to provide a system as described in which both single arm and paired-arm types of connectors, assymmetrical and otherwise, can readily be produced with differing arm spacings but with the arms perpendicular to selected hub-facets as desired.

BRIEF SUMMARY OF THE INVENTION

In brief summary given as cursive description only and not as limitation, the invention includes a flexible pluralpart hub wall system assemblable over a precision template member which determines arm-angles and becomes a part of the completed connector.

BRIEF DESCRIPTION OF THE DRAWINGS

Like reference characters refer to like parts.

FIG. 1 is a plan view of an old art type connector;

FIG. 2 is a plan view of a first connector according to this invention;

FIG. 3 is a plan detail of a gusset for the first connector;

FIG. 4 is an elevational detail of the first connector, partially in section, taken at 4—4, FIG. 2;

FIG. 5 is a plan view of a second connector;

FIG. 6 is an elevational detail of the second connection partially in section, taken at 6—6, FIG. 5; and FIG. 7 is a detail of a modified embodiment, shown as in FIG. 5.

DETAILED DESCRIPTION OF THE DRAWINGS

FIG. 1 shows an old art connector C with hub H having relatively heavy polygonal wall construction from which a plurality of arms A extend. The connector has no gusset although gussets are known in some connectors. Construction of a variety of connectors of this type for a complete geodesic could be by casting, or more flexibly by fabrication piece-by-piece, but could, if by fabrication, require great care in fitting the pieces together and holding them during welding or the like, because of thermal expansion and warping.

THE INVENTION

FIGS. 2, 3 and 4 show the invention embodied in connector 10 as including a plurality of arms 20 in pairs, each pair 22 of arms extending perpendicularly from one of a plurality of axially-aligned facets 24 of a polygonal hub wall 26, assembled around a precision template 28 which also serves as a bracing means or gusset. All sets of arms are disposed about respective radii 30. Prior to assembly, the edges 32 of the template or gusset are sheared or otherwise formed to the precise angles relative to each other necessary to fix the hub-wall facets in position providing any selected peripheral angular-spacing between arms, within a substantial range of angular spacings.

The example shown is from an actual geodesic dome dimensional construction drawing. Peripheral angle-spacing between the pairs of arms in the example is at "a" and at "b",55.69°; at "c",60.65°; at "d", 64.30°; at "e", 61.52° and at "f", 62.15°. (One pair of arms is omitted in this type because no strut joins at that facet). The connectors are about 18 inches (45 cm) across and the hub may approximate $4\frac{1}{2}$ inches (11 cm) across.

Material may be $\frac{1}{8}$ inch (3 mm) thick mild steel or other suitable material. Assembly may be by welding as typically indicated at 34. The range of perpheral angles may span $\pm 5$ degrees, limited by the perforations maintaining a convex periphery of the hub.

Normally it would be very difficult to form a polygonal (hexagonal here) tubular hub-wall piecemeal or otherwise with precise angular spacing between arms or sets of arms radiating from the hub wall. However, the means for providing such in accordance with this invention include further provision rendering the hub wall relatively flexible on assembly, in that the hub wall is in at least two separate peripherally extending pieces *26a*, *26b*, which in construction of hubs with even numbers of facets are preferably substantially equal in peripheral extension. Each piece *26a*, *26b* shown here includes three facets 24, and the pieces can be preformed with the angles in the portions between the adjacent facets slightly closed so that the facets guide on and conformably spring against the gusset during assembly.

Another feature of the means providing a connector which assembles with precision at angles selected within a substantial range of angles is a special gusset shape. The corners are clipped off at the intersections of the edges 32, leaving an aperture 36 or spacing at the interior of the corners of the hub-wall, relieving hub wall construction tolerances and permitting the hub wall to flex more freely on assembly to fit the insides of facets 24 to the respective edges 32.

Still further features are apparent, which contribute to the precision attainable on assembly, in that the proportions leave a gap 38 between the adjacent ends of the hub wall on assembly, and, further, these gaps fall at respective apertures 36 providing better access and isolation so that thermal distortion on assembly by welding or brazing is minimized. The edges of the hub wall pieces at gaps form a troughlike shape suited for receiving a weld fillet. The gaps may also serve as ventilation openings and prevent accumulation condensation.

The arms 20 may be pre-assembled to the hub wall pieces, and being made separately may extend (FIG. 4) in lengthwise or generally radial direction any desired distance and at any desired elevation angle to the hub walls and hub axis, within a substantial range of such angles, easily ±45°. Conventional attachment holes 40 may be at any suitable location. Bends 42 may be long-radius bends.

The gusset 28 is recessed axially in the hub wall 26 a distance placing it as a brace at the average of the arm joining positions where it can most effectively transmit forces, making for a lighter and sturdier assembly.

The gaps may be about 1/16 inch (1.6 mm) across.

FIG. 5 shows a second connector 500 to illustrate versatility of the invention. In this the hub-wall has only five facets, 524*a*, 524*b*, 524*c*, 524*d*, 524*e*, corresponding to desired angular disposition of the arms, with one blank side 524*d* where the overall geodesic dome design needs no arm for this connector.

The two hub wall pieces are of different shape, 526*a* being a similar three-facet open-"U" shape like that of the first embodiment described and 526*b* being an "L" shape. In both cases the bends 542, 544 of the pieces find clearance at apertures 536, of the gussets 528, which apertures are proportioned as before to extend just past projections to the two adjacent arms, 520, 520*a* for example. The adjacent ends of the hub wall pieces have the pre-welding or assembly-aiding gaps 538 between, and meet at opposite sides of center 0.

Large hub-facet 524*e* bears single arm 520*c*, and it is in a relation to the hub facet rotated about the radial projection of the arm in plan view, showing further variation possible in arm disposition.

FIG. 6 shows an elevational detail of the FIG. 5 connector 500 in partial section, depicting further features in that gusset 528 may easily be axially moved along the hub wall 526 (down in the view) to brace at the average joining location of the arms, the hub wall being long enough in proportion to the arm width to support the arms 520 affixed at or extending somewhat below the hub length.

FIG. 7 shows at 720*c* a single-arm portion of the FIG. 5 assembly modified by having one end of rectangular metal tube 780 welded to the member 720*c* with the tube axis transverse to the length of the member 720*c* and parallel with plane of one side of side of the member 720*c* to which the tube is welded. This provides an integral transverse extension on 720*c* by which a two-by-four or other beam-type structure member can be attached as by screws through holes as at 782, or straight-through bolts may be employed. The member 780 may be split lengthwise as at 784 for easier fitting over a structural member.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a connector for geodesic dome struts, having a tubular hub wall of axially aligned facets forming interior corners of the hub wall, with a plurality of arms radiating lengthwise from respective of the facets in peripheral angular spacing and in elevational-angle relation to respective of said facets, the improvement comprising: said arms being perpendicular to respective of said facets in plan view, and a system for assembly to comprise a said connector with selected said peripheral angular-spacing between said arms, at least a majority of said arms being paired in plane-parallel relation, said system for assembly including means for bracing the hub-wall against forces applied in any direction along said struts, said hub wall and means for bracing being separate and requiring assembly, means rendering said hub wall flexible for assembly, and said hub wall flexibly guidable on said means for bracing during assembly, including: said bracing means being in the form of a gusset for assembly to said hub wall, a plurality of peripheral edges on said gusset in pre-selected adjacent relation for correspondence with respective adjacent facets of said hub wall, the means rendering the hub wall flexible for assembly to the gusset comprising said hub wall being in two separate peripherally extending pieces prior to assembly, said two separate peripherally extending pieces being substantially equal in peripheral extension, said means rendering the hub wall flexible for assembly further including said peripheral extension leaving peripheral gaps between said two separate peripherally extending pieces on assembly, said peripheral gaps proportioned for receiving material for joining said at least two separate peripherally extending pieces on assembly, and means for better conforming the gusset to the hub wall on assembly, comprising said adjacent edges on the gusset being straight and with the corners cut off leaving respective spacings at the interior corners of the hub wall.

2. In a connector as recited in claim 1, at least one of said arms rotated about the axis of said radiation, and a rectangular tubular member integral with said arms, thereby providing for beam-type structural-member-attachment thereto.

* * * * *